US008876634B2

(12) United States Patent
Ban

(10) Patent No.: US 8,876,634 B2
(45) Date of Patent: Nov. 4, 2014

(54) GOLF CLUB HEAD

(75) Inventor: Wataru Ban, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 54 days.

(21) Appl. No.: 13/613,735

(22) Filed: Sep. 13, 2012

(65) Prior Publication Data

US 2013/0130833 A1 May 23, 2013

(30) Foreign Application Priority Data

Nov. 21, 2011 (JP) ..... 2011-254451
Nov. 21, 2011 (JP) ..... 2011-254452

(51) Int. Cl.
*A63B 53/00* (2006.01)
*A63B 53/04* (2006.01)

(52) U.S. Cl.
CPC ..... *A63B 53/0466* (2013.01); *A63B 2053/0437* (2013.01); *A63B 2053/0412* (2013.01); *A63B 2053/045* (2013.01)
USPC ..... 473/346

(58) Field of Classification Search
CPC . A63B 53/04; A63B 53/0466; A63B 59/0092
USPC ..... 473/346, 345
See application file for complete search history.

(56) References Cited

U.S. PATENT DOCUMENTS 5,908,356 A 6/1999 Nagamoto
6,595,871 B2 7/2003 Sano
6,645,087 B2 11/2003 Yabu
7,273,423 B2 9/2007 Imamoto
7,390,271 B2 6/2008 Yamamoto
7,563,175 B2 7/2009 Nishitani et al.
7,806,781 B2 10/2010 Imamoto
7,828,676 B2 11/2010 Wada et al.
8,033,932 B2 10/2011 Wada et al.
2001/0029210 A1* 10/2001 Murphy et al. ..... 473/345
2004/0053705 A1* 3/2004 Kumamoto ..... 473/345
2007/0149313 A1* 6/2007 Matsunaga et al. ..... 473/332
2010/0016097 A1* 1/2010 Albertsen et al. ..... 473/327
2010/0022327 A1 1/2010 Nakano
2010/0048324 A1* 2/2010 Wada et al. ..... 473/346
2010/0120556 A1 5/2010 Yamamoto et al.
2010/0273574 A1 10/2010 Yamamoto

FOREIGN PATENT DOCUMENTS

JP 01-068285 A 3/1989
JP 05-015620 A 1/1993
JP 07-194746 A 8/1995
JP 09-099121 A 4/1997
JP 09-173509 A 7/1997
JP 09-182817 A 7/1997
JP 09-248353 A 9/1997
JP 10-024128 A 1/1998
JP 11-313906 A 11/1999
JP 2001-346918 A 12/2001
JP 2001-353240 A 12/2001

(Continued)

*Primary Examiner* — Michael Dennis
(74) *Attorney, Agent, or Firm* — Sughrue Mion, PLLC

(57) ABSTRACT

A golf club head according to this invention includes a face portion, a crown portion having a shape which bulges out upward, and a sole portion. The crown portion includes a vibration promotion region and a surrounding region which surrounds the vibration promotion region. The vibration promotion region has a circular or elliptical shape, and is flatter than the surrounding region.

15 Claims, 15 Drawing Sheets

(56) References Cited

FOREIGN PATENT DOCUMENTS

| | | | |
|---|---|---|---|
| JP | 2002-017910 | A | 1/2002 |
| JP | 2002-113134 | A | 4/2002 |
| JP | 2002-126136 | A | 5/2002 |
| JP | 2002-186691 | A | 7/2002 |
| JP | 2003-102877 | A | 4/2003 |
| JP | 2005-160947 | A | 6/2005 |
| JP | 2006-204604 | A | 8/2006 |
| JP | 2008-173293 | A | 7/2008 |
| JP | 2009-233266 | A | 10/2009 |
| JP | 2010-029358 | A | 2/2010 |
| JP | 2010-035915 | A | 2/2010 |
| JP | 2010-115334 | A | 5/2010 |
| JP | 2010-234108 | A | 10/2010 |
| JP | 2010-252897 | A | 11/2010 |
| JP | 2011-062255 | A | 3/2011 |

* cited by examiner

GOLF CLUB HEAD

BACKGROUND OF THE INVENTION

1. Field of the Invention

The present invention relates to a hollow golf club head.

2. Description of the Related Art

The volume of a hollow golf club head increases every year, making the crown portion and sole portion thinner but larger in area. Therefore, a low-pitched impact sound is more likely to be generated at the time of striking a golf ball. Under the circumstances, golfers who prefer high-pitched impact sounds want golf club heads that generate higher-pitched impact sounds.

As a method for improving an impact sound, Japanese Patent Laid-Open No. 2009-233266 discloses a golf club head including a rib which traverses the sole portion, side portion, and crown portion. Also, Japanese Patent Laid-Open No. 2010-35915 discloses a golf club head including a recessed portion formed in the crown portion.

The recent golf club head often has a sole portion having a shape as its design feature. Therefore, a structure for improving an impact sound has a level of freedom higher in the crown portion than in the sole portion.

However, the crown portion generally has a shape which bulges out upward, and therefore has a relatively large curvature. Therefore, an impact sound with poor resonance is more likely to be generated.

SUMMARY OF THE INVENTION

It is an object of the present invention to provide a golf club head which generates a higher-pitched impact sound with better resonance.

According to the present invention, there is provided a hollow golf club head including a face portion, a crown portion having a shape which bulges out upward, and a sole portion, wherein the crown portion includes a vibration promotion region and a surrounding region which surrounds the vibration promotion region, and the vibration promotion region has one of a circular shape and an elliptical shape, and is flatter than the surrounding region.

Further features of the present invention will become apparent from the following description of exemplary embodiments with reference to the attached drawings.

DESCRIPTION OF THE EMBODIMENTS

First Embodiment

Figure 1:
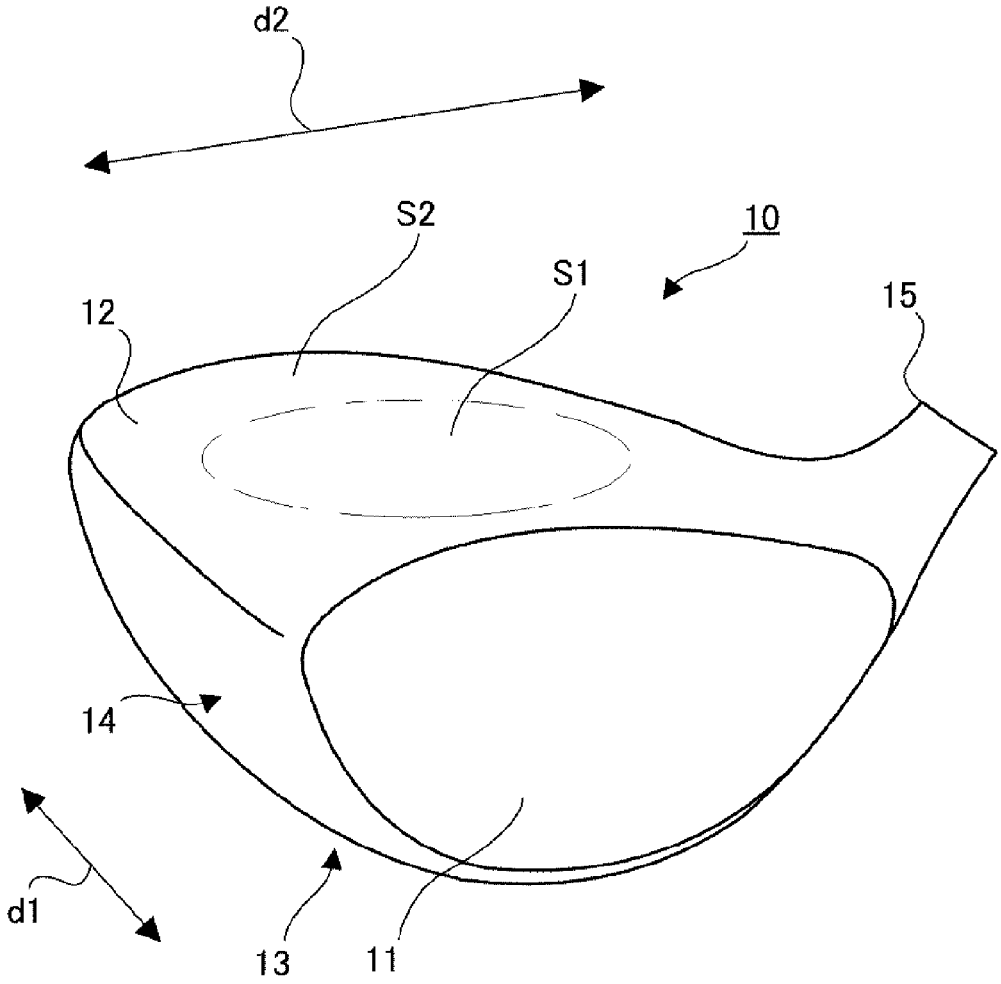
FIG. 1 is a perspective view of a golf club head according to an embodiment of the present invention.
Figure 2:
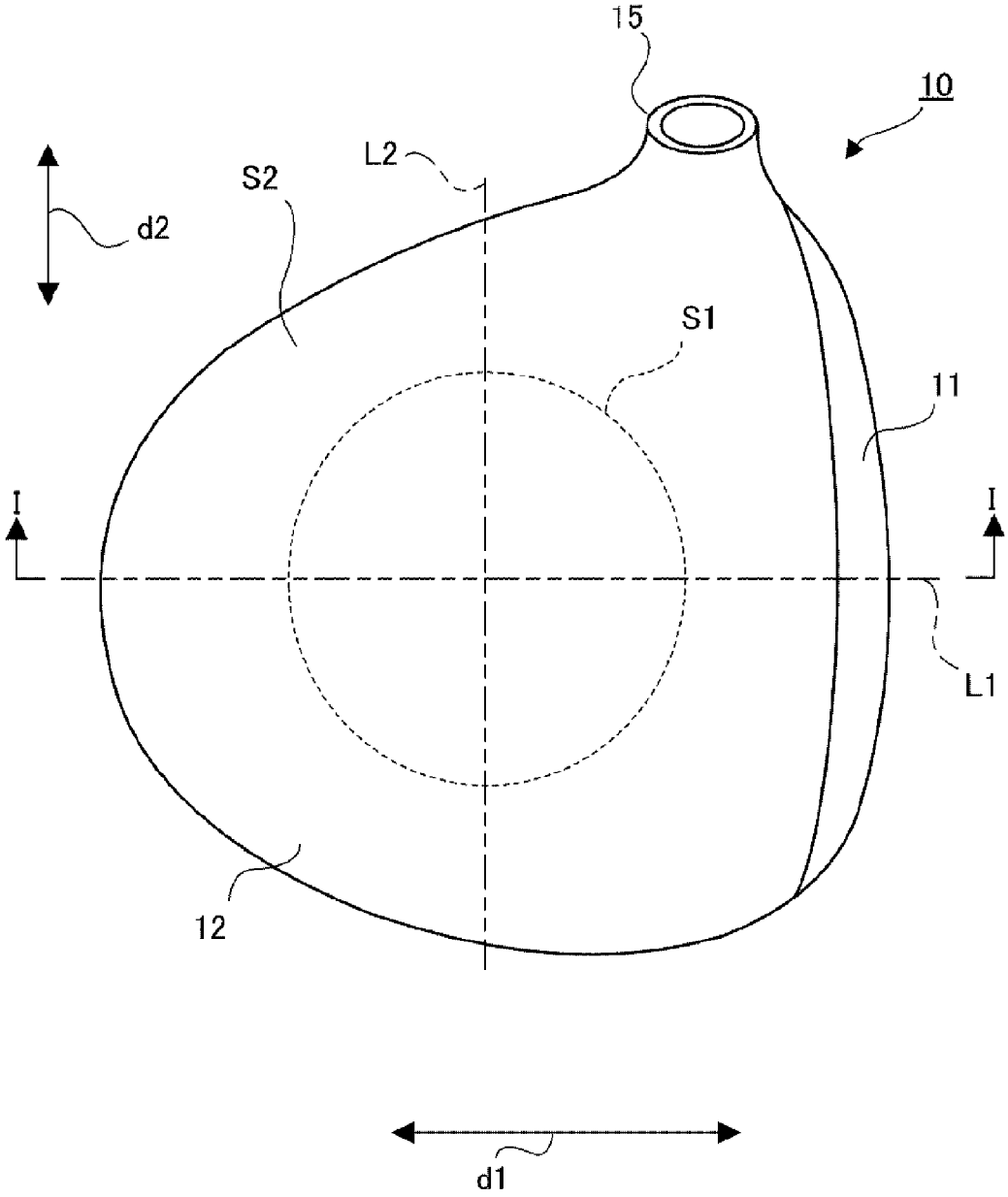
FIG. 2 is a plan view of the golf club head shown in FIG. 1.
Figure 3:
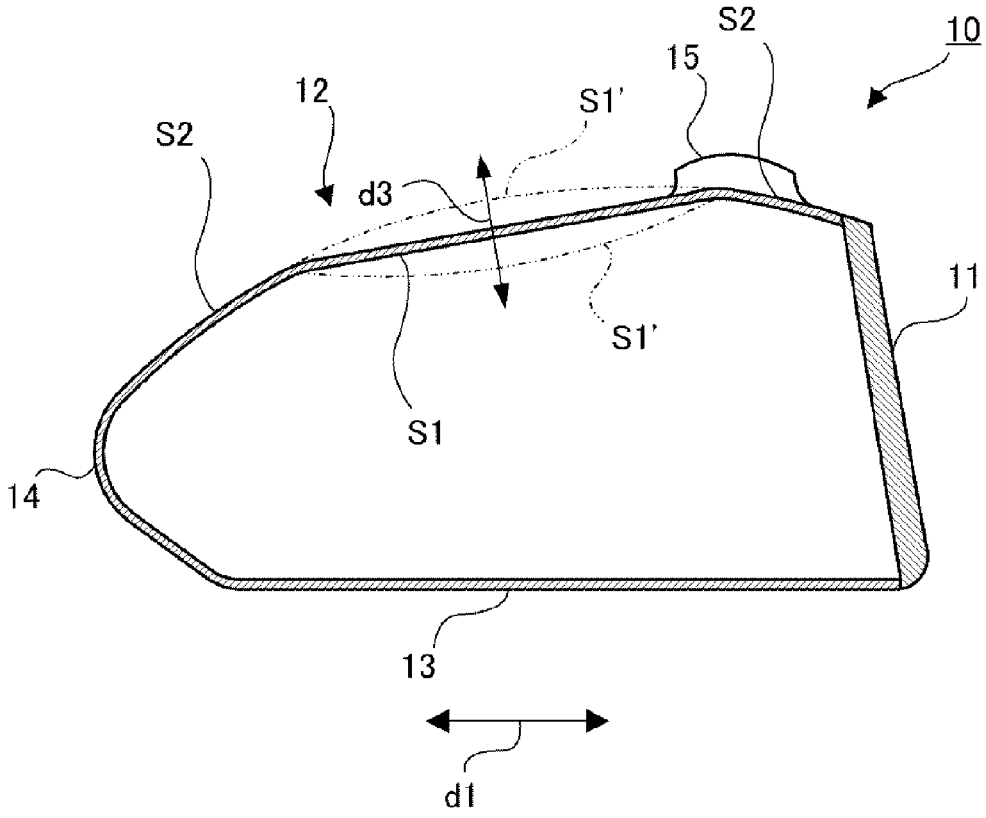
FIG. 3 is a sectional view taken along a line I-I in FIG. 2.

FIG. 1 is a perspective view of a golf club head 10 according to an embodiment of the present invention, FIG. 2 is a plan view of the golf club head 10, and FIG. 3 is a sectional view taken along a line I-I in FIG. 2. Referring to FIGS. 1 to 3, double-headed arrows d1 indicate the face-to-back direction, and double-headed arrows d2 indicate the toe-to-heel direction. Note that the face-to-back direction means a horizontal direction along the flight trajectory direction when the golf club head 10 is grounded at a specific lie angle defined for the golf club head 10, and is normally the in-plane direction of a plane perpendicular to the central portion of a face portion 11. The toe-to-heel direction means a horizontal direction perpendicular to the face-to-back direction when the golf club head 10 is grounded at the specific lie angle.

The golf club head 10 takes the form of a hollow body, and its peripheral wall forms the face portion 11, a crown portion 12, a sole portion 13, and a side portion 14. The face portion 11 forms a face surface (striking surface). The crown portion 12 forms the top portion of the golf club head 10. The sole portion 13 forms the bottom portion of the golf club head 10. The side portion 14 forms the side portion of the golf club head 10. The side portion 14 includes toe-, back-, and heel-side portions. The golf club head 10 also includes a hosel portion 15 to which a shaft is to be attached.

The golf club head 10 is a driver golf club head. However, the present invention is applicable to wood type golf club heads including not only a driver golf club head but also, for example, a fairway wood type golf club head, utility (hybrid) type golf club heads, and other hollow golf club heads. The golf club head 10 can be made of a metal material such as a titanium-based metal (for example, 6Al-4V-Ti titanium alloy), stainless steel, or a copper alloy such as beryllium copper.

The entire crown portion 12 has a shape which bulges out upward. In this embodiment, the crown portion 12 includes a vibration promotion region S1 and a surrounding region S2 which surrounds the vibration promotion region S1. Again in this embodiment, the entire region of the crown portion 12, other than the vibration promotion region S1, is the surrounding region S2.

Figure 8:
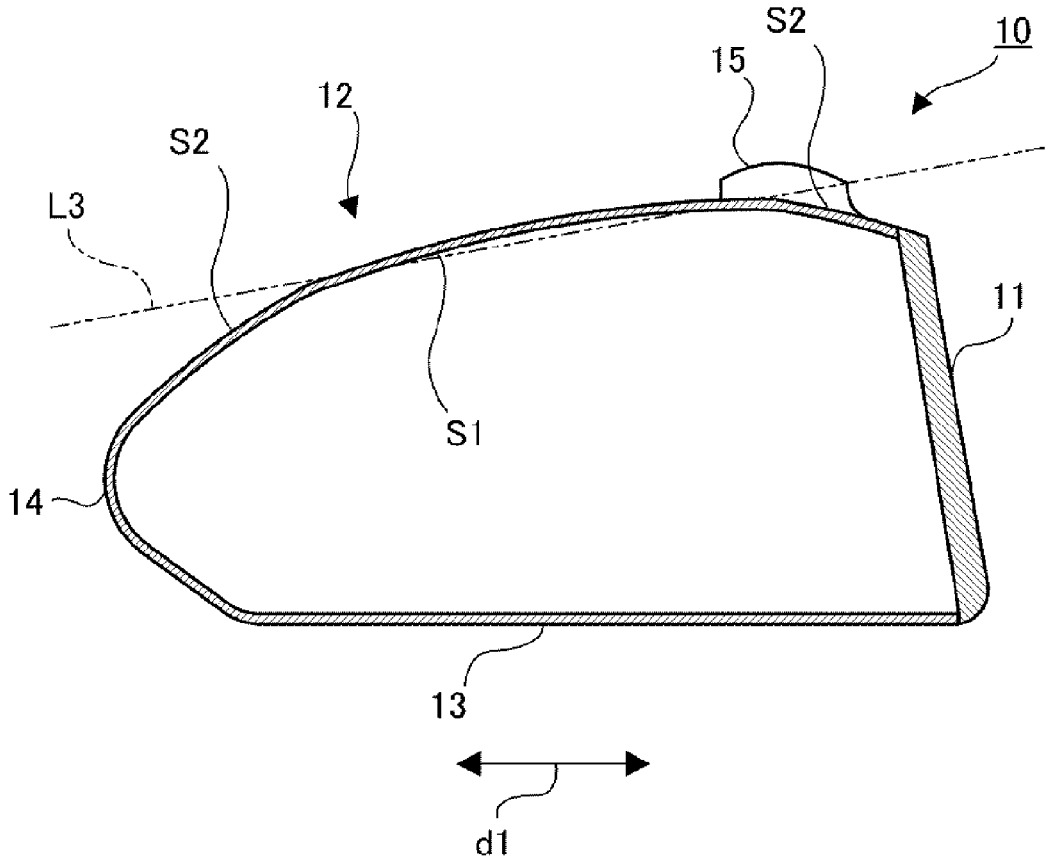
FIG. 8 is a view showing another mode of a vibration promotion region.

In this embodiment, the vibration promotion region S1 is a flat region having a surface flush with a virtual plane L3 which passes through the boundary between the vibration promotion region S1 and the surrounding region S2. However, the vibration promotion region S1 need not always be flat, and need only be flatter than the surrounding region S2. That is, the vibration promotion region S1 need only have a curvature smaller than that of the surrounding region S2. Therefore, the vibration promotion region S1 may bulge out more to the top than the virtual plane L3, like that shown in, for example, FIG. 8.

In this embodiment, the vibration promotion region S1 has a circular shape. However, the vibration promotion region S1 may have an elliptical shape. The vibration promotion region S1 can be formed at an arbitrary position in the crown portion 12, but is preferably formed at the central portion of the crown portion 12 in terms of ease in generating vibration with a large amplitude at the time of impact. In this embodiment, the vibration promotion region S1 has a circular shape using the intersection point between lines L1 and L2 shown in FIG. 2 as its center. The line L1 is a virtual line which is parallel to the face-to-back direction and passes through the center of the face portion 11. The line L2 is a virtual line which is perpendicular to the line L1 and passes through the center of the crown portion 12 in the face-to-back direction. The position of the vibration promotion region S1 in this embodiment is almost the center of the crown portion 12.

In general, as the head volume increases, it is necessary to reduce the thickness of the peripheral wall of the head while a required strength is ensured. The thickness of the crown portion 12 is preferably, for example, 0.3 mm (inclusive) to 1.0 mm (inclusive). Note that when the thickness of the crown portion 12 is to be set relatively large, it is preferably 1.2 mm (inclusive) to 2.5 mm (inclusive).

As the head volume increases, the area of each portion, in turn, increases, so the eigenvalue of the entire head decreases, and the eigenvalue (natural frequency) of the first-order vibration mode of the crown portion 12, in turn, decreases. In this case, therefore, a low-pitched impact sound is more likely to be generated at the time of striking a golf ball.

In this embodiment, the curvature of the vibration promotion region S1 rapidly increases on its peripheral edge. With this arrangement, the entire crown portion 12 is constrained, so the eigenvalue of its first-order vibration mode increases. The vibration promotion region S1 has a curvature smaller than that of the surrounding region S2, and therefore can more easily vibrate. FIG. 3 schematically shows the vibration mode of the vibration promotion region S1 with exaggeration. The vibration promotion region S1 vibrates in a direction indicated by a double-headed arrow d3 while forming a trace indicated by a broken line S1'. This makes it possible to generate a higher-pitched impact sound with better resonance. Also, since the vibration promotion region S1 is simply flatter than the surrounding region S2, it is hardly noticeable when the golf club head 10 is viewed in a plan view. This makes it possible to prevent golfers from feeling a sense of discomfort in appearance upon address.

Note that the vibration promotion region S1 preferably includes the position of an antinode of the first-order vibration mode of the crown portion 12. This increases the vibration amplitude of the vibration promotion region S1, thereby further improving the resonance of an impact sound. The position of an antinode of the first-order vibration mode of the crown portion 12 can be obtained by modal analysis using a computer or eigenvalue analysis using the FEM.

Also, the vibration promotion region S1 may be thinner than the surrounding region S2. With this arrangement, the vibration promotion region S1 can more easily vibrate.

As the area of the vibration promotion region S1 reduces, an impact sound may have a higher pitch but have poorer resonance. Hence, the area of the vibration promotion region S1 is preferably, for example, 700 to 8,000 $mm^2$.

Second Embodiment

A rib may be formed in a crown portion 12 in a region other than a vibration promotion region S1. Forming a rib makes it possible to further increase the eigenvalue of the first-order vibration mode of the crown portion 12, thereby increasing the pitch of an impact sound.

A rib is preferably formed on the inner peripheral surface of the crown portion 12. This makes it possible to make the rib invisible from the outside. A rib can be formed in the crown portion 12 by welding as a member separate from the parts which constitute the crown portion 12. However, forming a rib integrally with the constituent parts of the crown portion 12 makes it possible to reduce the number of parts, and therefore makes it easy to assemble them. An example in which ribs are formed integrally with the constituent parts of the crown portion 12 will be described below.

Figure 4:
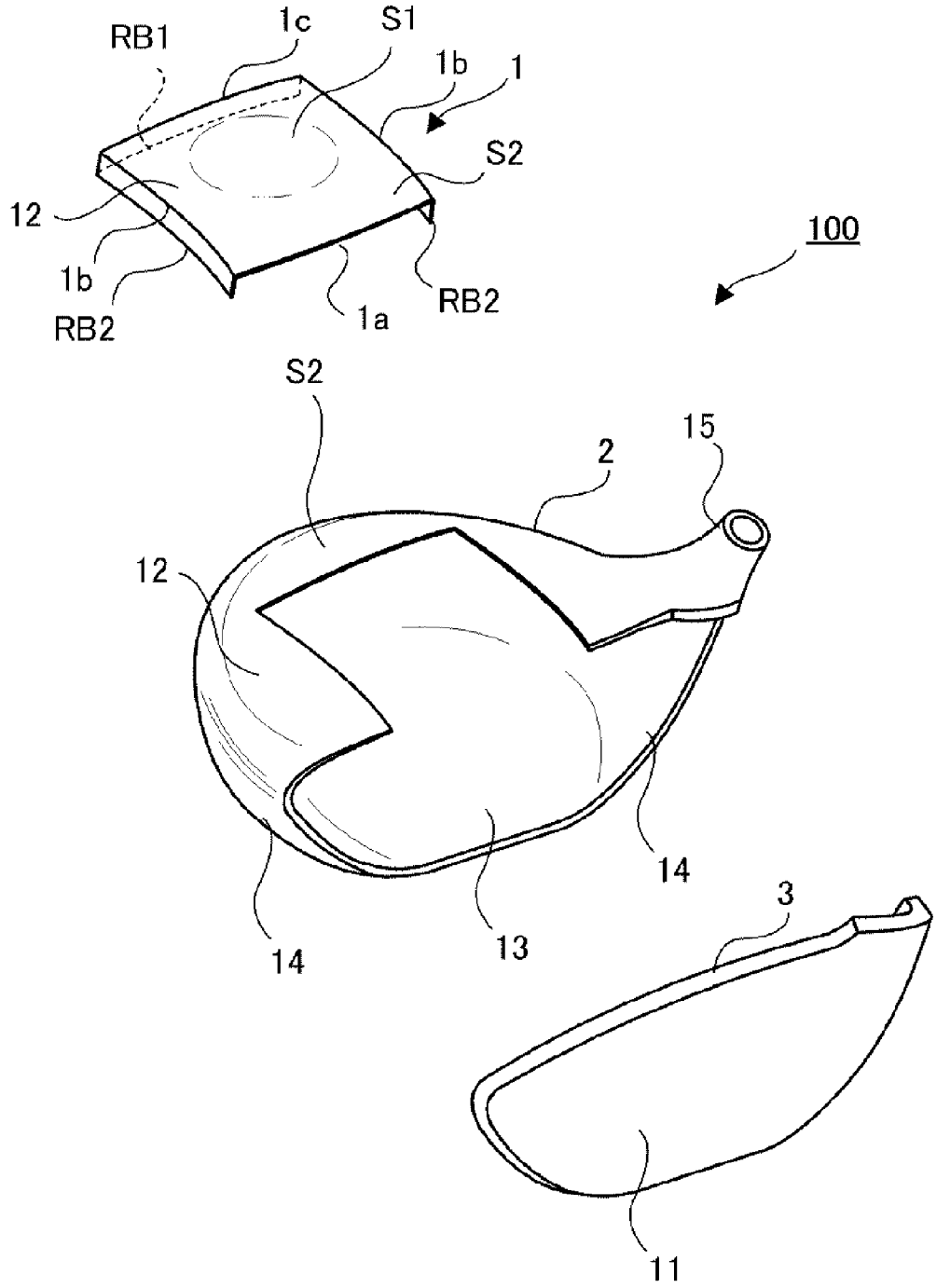
FIG. 4 is an exploded perspective view of a golf club head according to another embodiment of the present invention.
Figure 5:
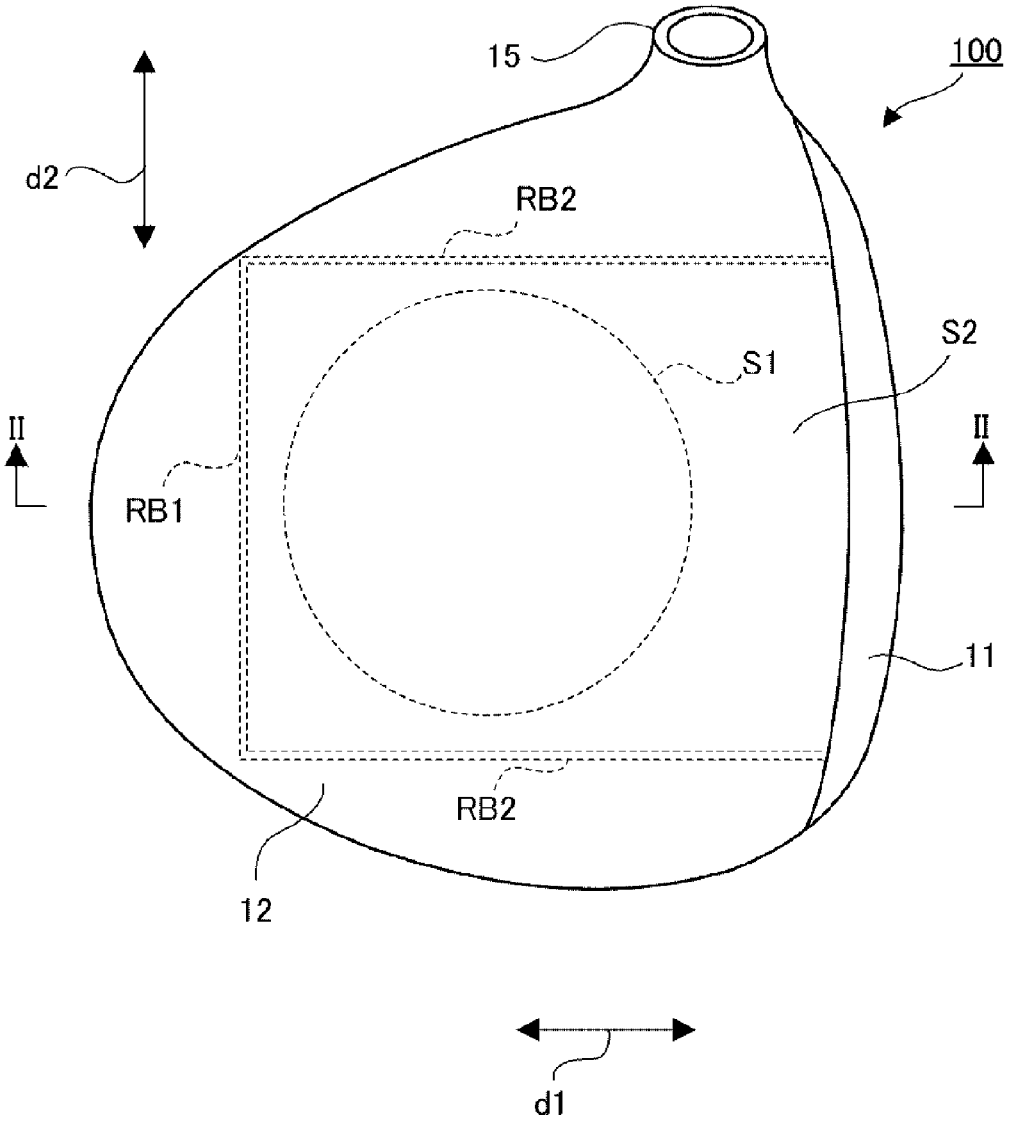
FIG. 5 is a plan view of the golf club head shown in FIG. 4.
Figure 6:
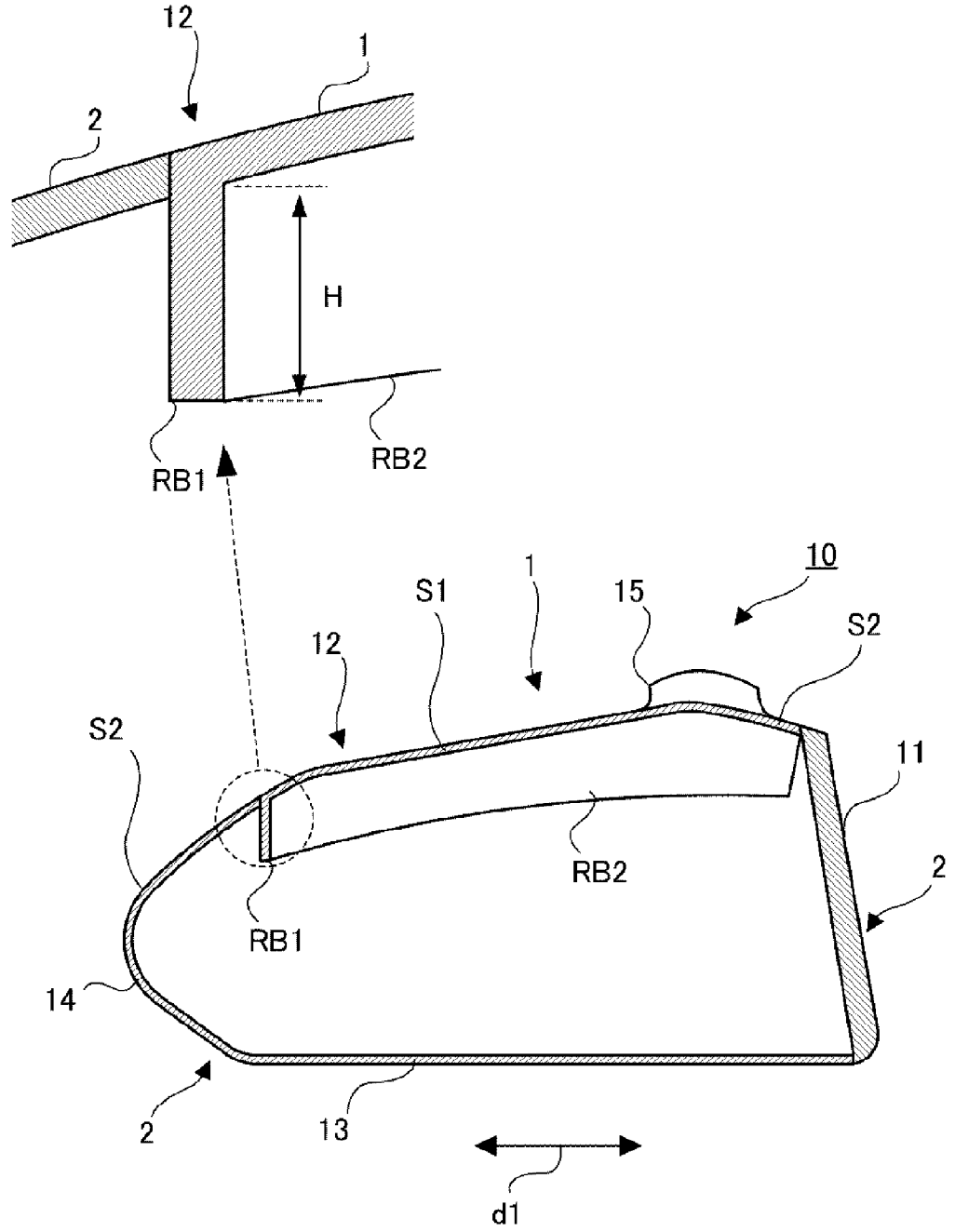
FIG. 6 shows a sectional view taken along a line II-II in FIG. 5, and a partial enlarged view.

FIG. 4 is an exploded perspective view of a golf club head 100 according to another embodiment of the present invention, FIG. 5 is a plan view of the golf club head 100, and FIG. 6 shows a sectional view taken along a line II-II in FIG. 5, and a partial enlarged view. The same reference numerals as in the above-mentioned golf club head 10 denote the same constituent parts of the golf club head 100, and a description thereof will not be given.

The golf club head 100 in this embodiment is formed by connecting a plurality of shell members 1 to 3 to each other. As a method of connecting the shell members 1 to 3 to each other, welding or adhesion, for example, is available, but welding is preferable in terms of connection strength. In this embodiment, the shell member 1 forms part of the crown portion 12. The shell member 2 forms part of the crown portion 12, a sole portion 13, a side portion 14, and a hosel portion 15. The shell member 3 forms a face portion 11.

The crown portion 12 is formed by connecting the shell members 1 and 2 to each other. The shell member 1 includes the entire vibration promotion region S1. Dividing the parts in this way makes it easy to form the vibration promotion region S1 especially when it is formed by forging.

The shell member 1 includes a front edge portion 1*a* on the side of the face portion 11, toe- and heel-side side edge portions 1*b*, and a back-side rear edge portion 1*c*. The front edge portion 1*a* is connected to the shell member 3 which forms the face portion 11. The side edge portions 1*b* and rear edge portion 1*c* are connected to the shell member 2.

Ribs are formed on the edge portion, other than the front edge portion 1*a*, among the edge portions of the shell member 1. That is, the rear edge portion 1*c* is provided with a rib RB1, and the side edge portions 1*b* are provided with ribs RB2. The front edge portion 1*a* is provided with no rib. This is because the front edge portion 1*a* is connected to the shell member 3 which forms the face portion 11, so the shell member 3 can ensure a constraint force which acts on the front edge portion 1*a*. However, the front edge portion 1*a* can also be provided with a rib. As described above, in this embodiment, the ribs RB1 and RB2 are formed across the entire region of the connection portion between the shell members 1 and 2.

The shell member 1 can be formed by forging a metal plate member. At this time, the ribs RB1 and RB2 can be formed by bending the end portions of the plate member. Hence, a rib can be formed more easily in this case than when the ribs RB1 and RB2 are formed as separate members.

The formation of the shell members 1 to 3 by forging offers a great advantage in easily forming thin shell members 1 to 3. As the head volume increases, it is necessary to reduce the thickness of the peripheral wall of the head. If casting is adopted as a manufacturing method, it is often difficult to reduce the thicknesses of the crown portion 12 and ribs RB1 and RB2 due to factors associated with the molten metal fluidity and the generation of blowholes.

Even if forging is adopted, a method of forming the crown portion 12 and ribs RB1 and RB2 as separate members, and connecting them to each other is troublesome. In this embodiment, a crown portion 12 and ribs RB1 and RB2 with smaller thicknesses can be formed more easily.

In terms of reducing the thickness in this way, the shell members 1 to 3 are preferably all forged members but may be a combination with a forged member. Even if the shell members 1 to 3 are a combination with a forged member, at least the shell member 1 which forms most of the crown portion 12 is preferably a forged member because the formed product is required to attain a given precision.

Although the golf club head 100 is formed by the three shell members 1 to 3 in this embodiment, the number of divided shell members is not limited to this. In this embodiment, the golf club head 100 can also be formed by, for example, a minimum of two shell members. The parts of the head 100 are preferably divided using the ribs RB1 and RB2 as boundaries. Dividing the parts of the head 100 in this way makes it possible to form ribs integrally with the shell members.

In this embodiment, forming the ribs RB1 and RB2 makes it possible to further increase the eigenvalue of the first-order vibration mode of the crown portion 12, thereby increasing the pitch of an impact sound. Especially, since the vibration promotion region S1 is surrounded by the ribs RB1 and RB2 and face portion 11, the region around the vibration promotion region S1 is highly constrained. Hence, the vibration promotion region S1 vibrates at higher frequencies, thereby increasing the pitch of an impact sound.

A height H (FIG. 6) of the rib RB1 from the crown portion 12 is desirably high to a certain degree to improve the effect of constraining the crown portion 12. Also, the height H of the rib RB1 may be uniform or different across the entire rib RB1. In either case, the maximum height of the rib RB1 is preferably 2.0 mm or more. The same applies to the ribs RB2.

Third Embodiment

Figure 7A:
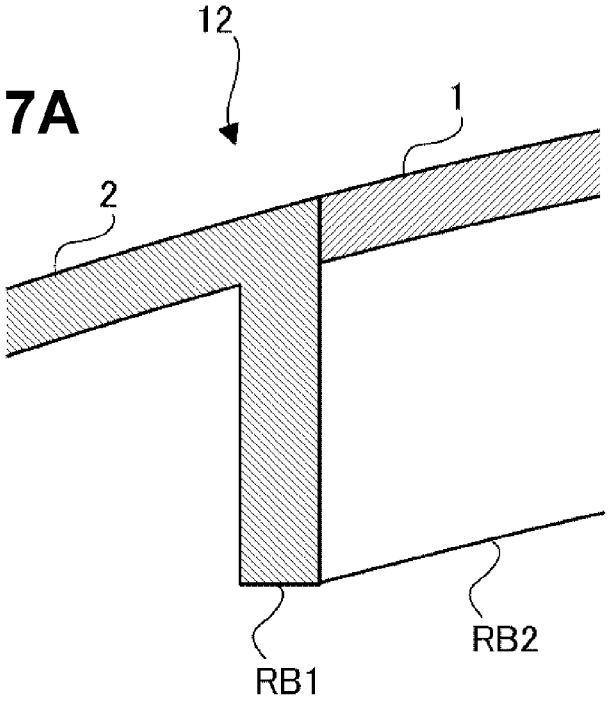
FIGS. 7A and 7B are views illustrating examples of how to connect shell members to each other.

Although the shell member 1 includes the ribs RB1 and RB2 in the above-mentioned second embodiment, the shell member 2 may include at least one of the ribs RB1 and RB2. FIG. 7A illustrates an example in which a shell member 2 includes a rib RB1, and a shell member 1 includes a rib RB2.

Figure 7B:
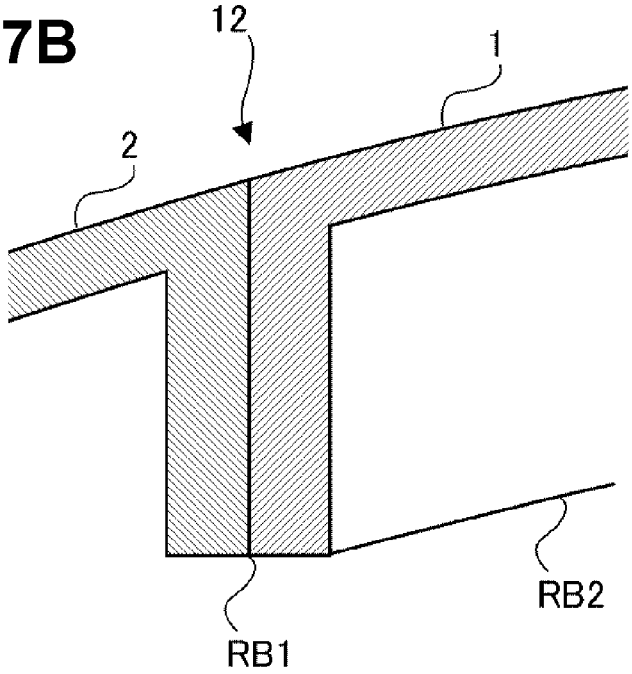

However, each of the shell members 1 and 2 may include a portion in which a rib is formed. Referring to FIG. 7B, both the shell members 1 and 2 include portions in which ribs RB1 are formed. As a result, the ribs RB1 are connected to each other to form a two-layered structure.

Fourth Embodiment

Figure 9:
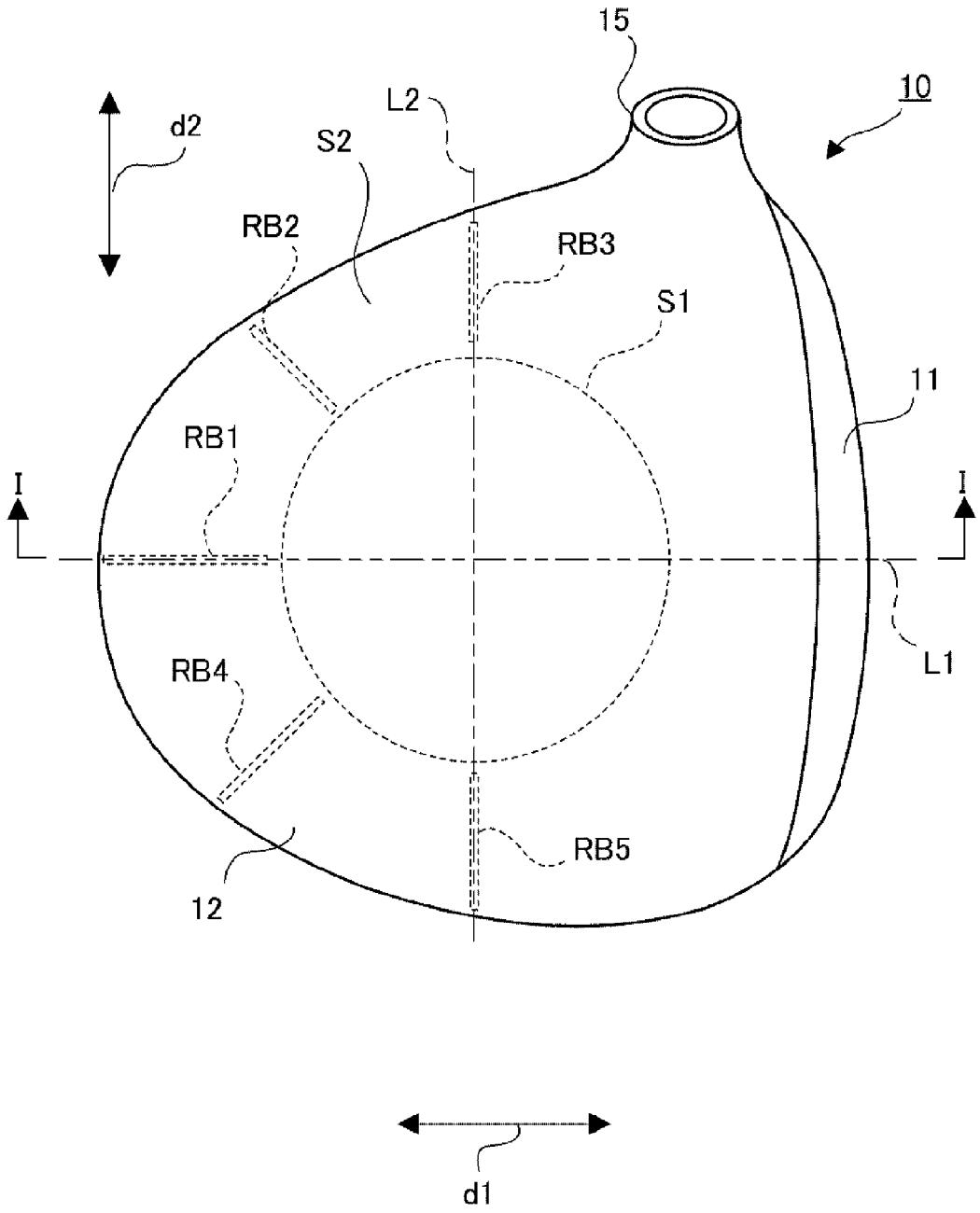
FIG. 9 is a plan view of a golf club head according to still another embodiment of the present invention.

Another example of the arrangement of ribs will be described. FIG. 9 is a plan view of a golf club head 10 according to this embodiment.

Figure 15:
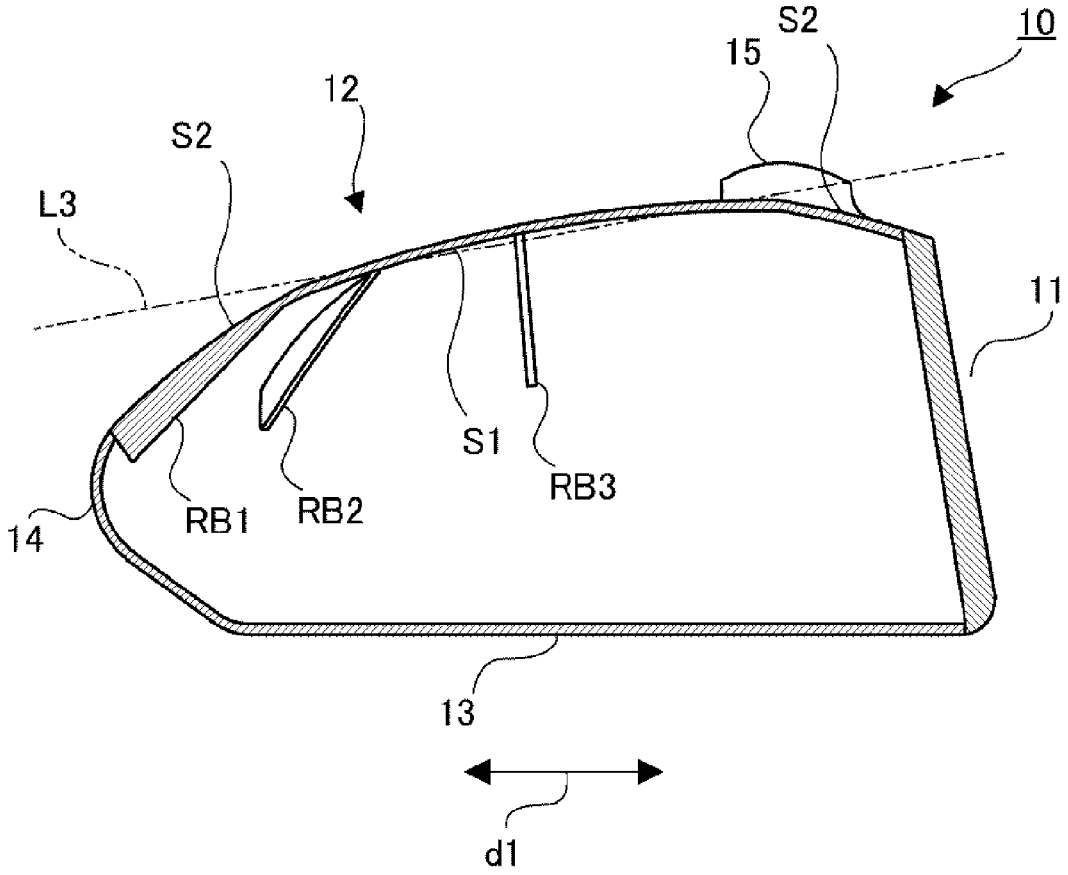
FIG. 15 is a view showing still another mode of the vibration promotion region.

In this embodiment, a vibration promotion region S1 is a flat region having a surface flush with a virtual plane L3 which passes through the boundary between the vibration promotion region S1 and a surrounding region S2. However, the vibration promotion region S1 need not always be flat, and need only be flatter than the surrounding region S2. That is, the vibration promotion region S1 need only have a curvature smaller than that of the surrounding region S2. Therefore, the vibration promotion region S1 may bulge out more to the top than the virtual plane L3, like that shown in, for example, FIG. 15.

A crown portion 12 is provided with ribs RB1 to RB5. The ribs RB1 to RB5 extend outwards from the side of the vibration promotion region S1, on the outer side of the vibration promotion region S1. In this embodiment, especially, the ribs RB1 to RB5 extend in a radial pattern having the vibration promotion region S1 as its center. Although the ribs RB1 to RB5 are formed in the surrounding region S2, they may extend to a side portion 14 or a sole portion 13.

In this embodiment, the ribs RB1 to RB5 are formed on the inner peripheral surface of the crown portion 12. This makes it possible to make the ribs RB1 to RB5 invisible from the outside. Again in this embodiment, the levels of the ribs RB1 to RB5 are relatively low on the side of the vibration promotion region S1 and relatively high on its opposite side. However, the levels of the ribs RB1 to RB5 may be uniform throughout their longitudinal directions.

Figure 10:
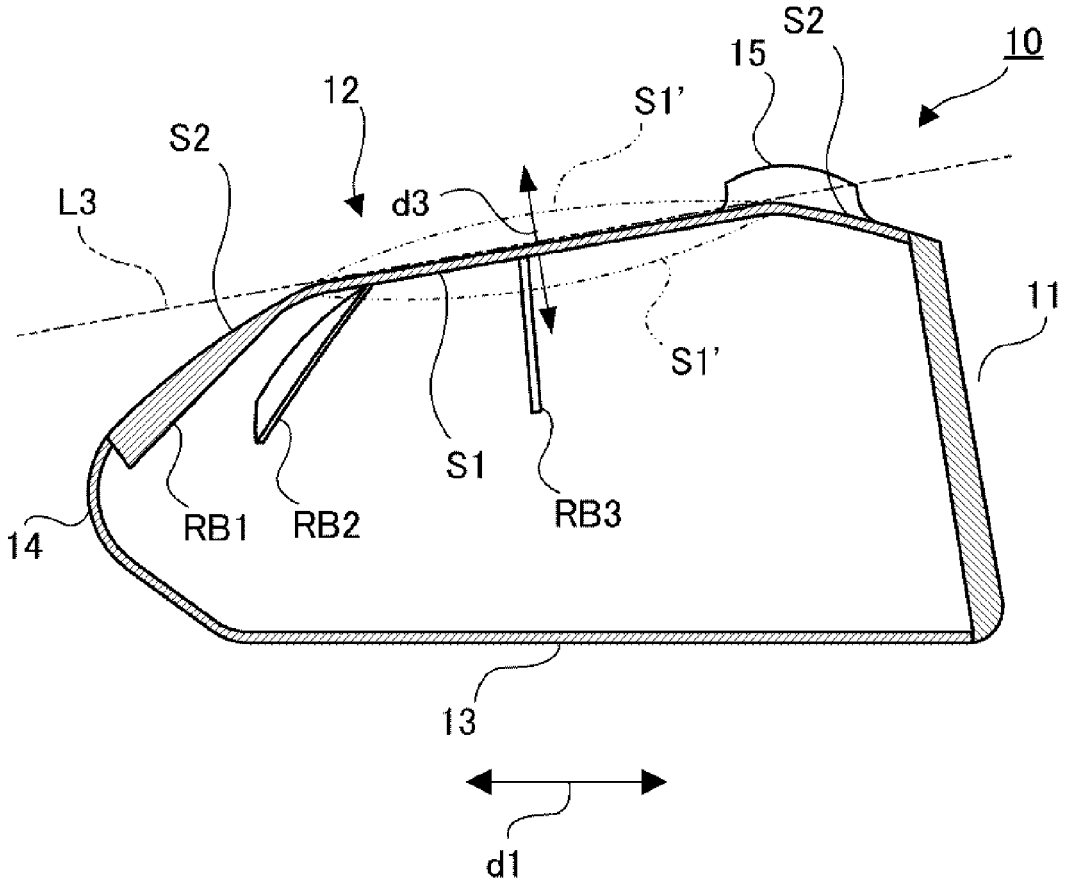
FIG. 10 is a sectional view taken along a line I-I in FIG. 9.

In this embodiment as well, the curvature of the vibration promotion region S1 rapidly increases on its peripheral edge. With this arrangement, the entire crown portion 12 is constrained, so the eigenvalue of its first-order vibration mode increases. The vibration promotion region S1 has a curvature smaller than that of the surrounding region S2, and therefore can more easily vibrate. FIG. 10 schematically shows the vibration mode of the vibration promotion region S1 with exaggeration. The vibration promotion region S1 vibrates in a direction indicated by a double-headed arrow d3 while forming a trace indicated by a broken line S1'. This makes it possible to generate a higher-pitched impact sound with better resonance. Also, since the vibration promotion region S1 is simply flatter than the surrounding region S2, it is hardly noticeable when the golf club head 10 is viewed in a plan view. This makes it possible to prevent golfers from feeling a sense of discomfort in appearance upon address.

Also, since the ribs RB1 to RB5 are formed outside the vibration promotion region S1, it is possible to further increase the eigenvalue of the first-order vibration mode of the crown portion 12, thereby increasing the pitch of an impact sound. Again, since the ribs RB1 to RB5 are formed outside the vibration promotion region S1, the vibration amplitude of the vibration promotion region S1 reduces only slightly.

Moreover, since the levels of the ribs RB1 to RB5 are relatively low on the side of the vibration promotion region S1 and relatively high on its opposite side, the constraint forces of the ribs RB1 to RB5 are stronger at positions farther from the vibration promotion region S1 and weaker at positions closer to the vibration promotion region S1. Hence, the vibration amplitude of the vibration promotion region S1 reduces only slightly.

Again, since the ribs RB1 to RB5 extend in a radial pattern having the vibration promotion region S1 as its center, they more uniformly constrain the surrounding portions. As a result, the entire vibration promotion region S1 can vibrate more uniformly, thereby improving the resonance of an impact sound at the time of impact.

Although the five ribs RB1 to RB5 are used in this embodiment, two or more ribs need only be used. Nevertheless, three or more ribs are preferably used in terms of the degree of constraint. Also, although the face portion 11 is provided with no rib, it can be provided with a rib.

Note that the vibration promotion region S1 preferably includes the position of an antinode of the first-order vibration mode of the crown portion 12. This increases the vibration amplitude of the vibration promotion region S1, thereby further improving the resonance of an impact sound. The position of an antinode of the first-order vibration mode of the crown portion 12 can be obtained by modal analysis using a computer or eigenvalue analysis using the FEM.

Also, the vibration promotion region S1 may be thinner than the surrounding region S2. With this arrangement, the vibration promotion region S1 can more easily vibrate.

As the area of the vibration promotion region S1 reduces, an impact sound may have a higher pitch but have poorer resonance. Hence, the area of the vibration promotion region S1 is preferably, for example, 700 to 8,000 $mm^2$.

Figure 11:
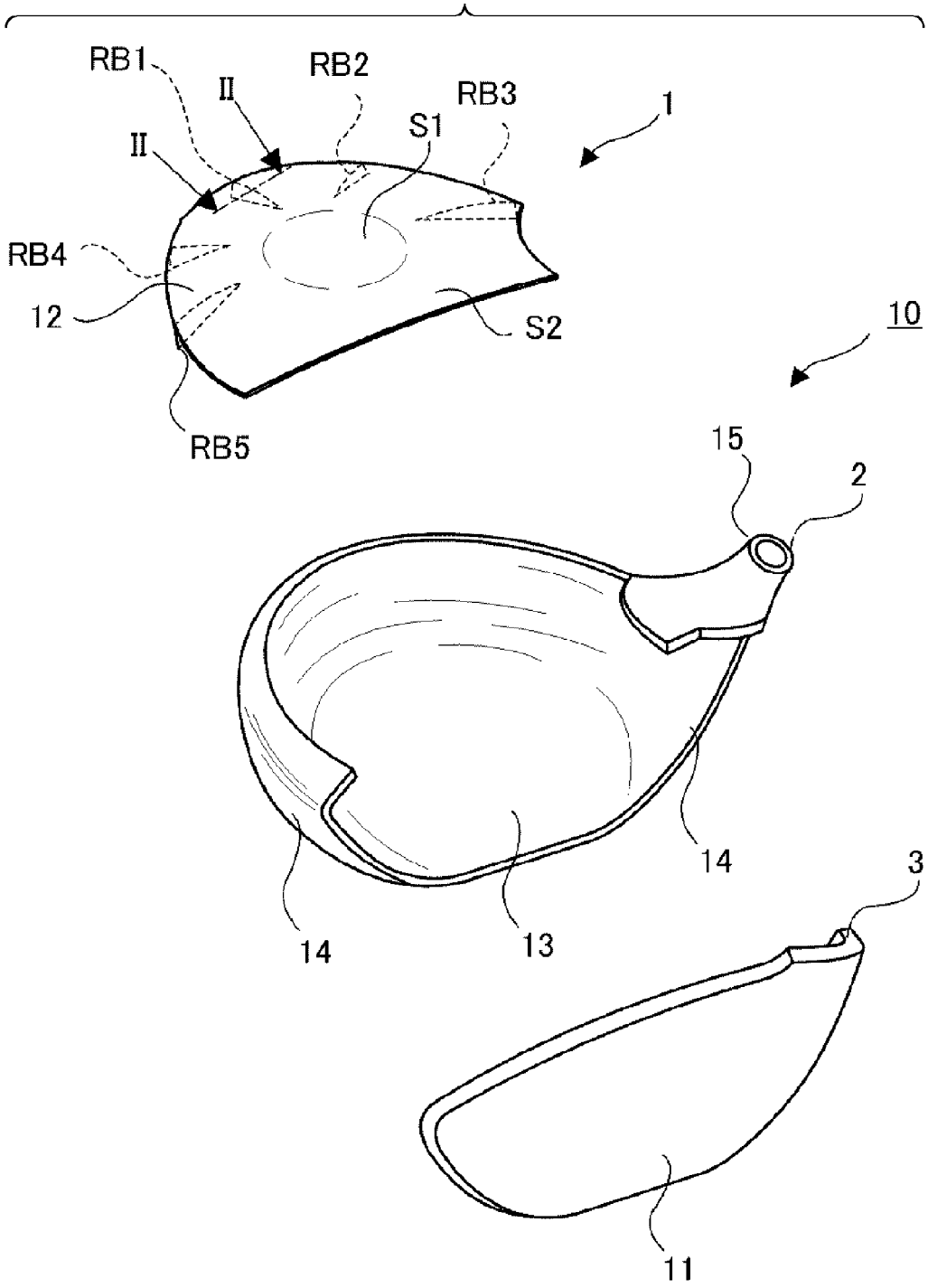
FIG. 11 is an exploded perspective view of the golf club head shown in FIG. 9.

An example of how to manufacture a golf club head 10 will be described next. Ribs RB1 to RB5 can be formed in the crown portion 12 by welding as members separate from the parts which constitute the crown portion 12. However, forming ribs RB1 to RB5 integrally with the constituent parts of the crown portion 12 makes it possible to reduce the number of parts, and therefore makes it easy to assemble them. An example in which ribs RB1 to RB5 are formed integrally with the constituent parts of the crown portion 12 will be described below. FIG. 11 is an exploded perspective view of the golf club head 10.

The golf club head 10 in this embodiment is formed by connecting a plurality of shell members 1 to 3 to each other. As a method of connecting the shell members 1 to 3 to each other, welding or adhesion, for example, is available, but welding is preferable in terms of connection strength. In this embodiment, the shell member 1 is a crown forming part which forms almost the entire region of the crown portion 12, and the ribs RB1 to RB5. The shell member 2 forms the peripheral edge portion of the crown portion 12, the sole portion 13, the side portion 14, and a hosel portion 15. The shell member 3 forms the face portion 11.

Figure 12:
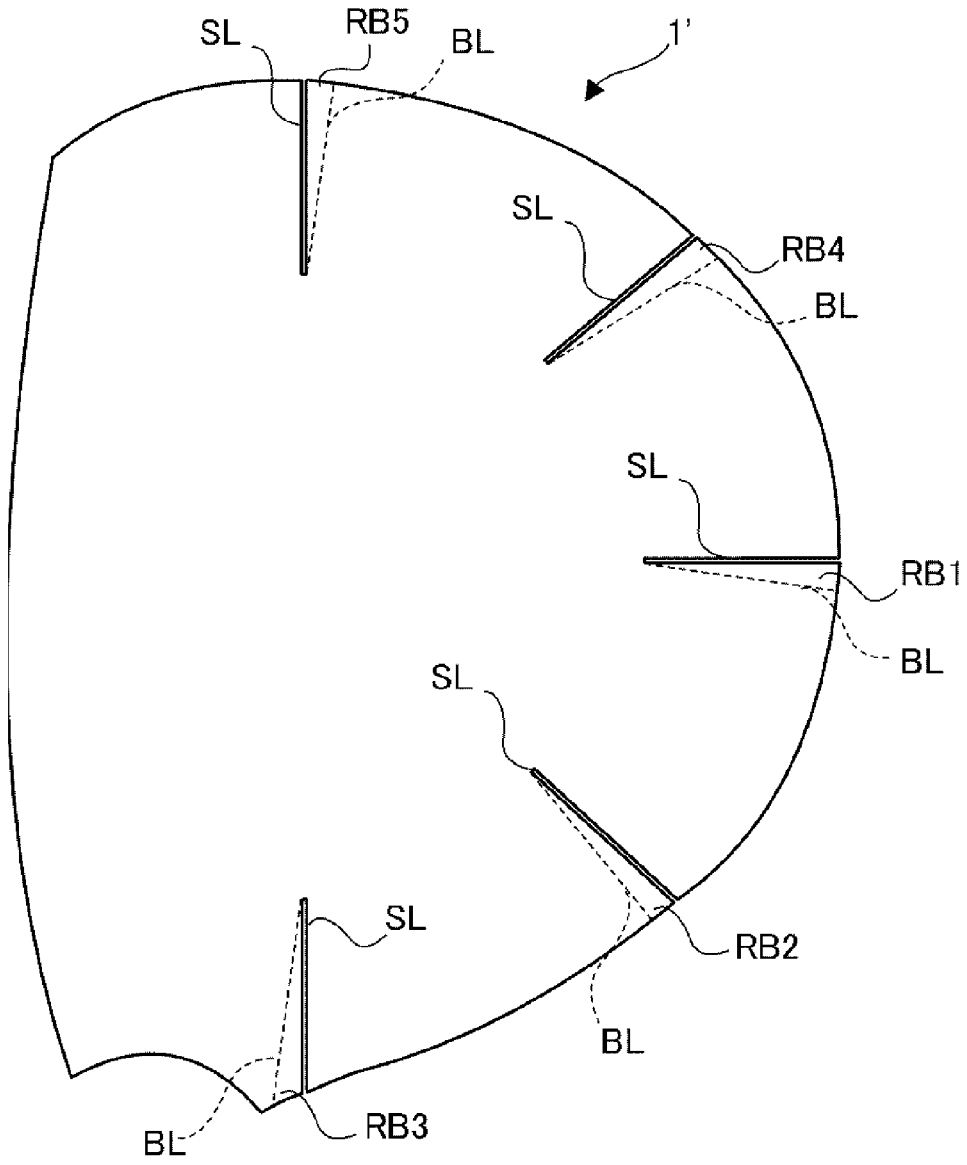
FIG. 12 is an exploded view of shell members.

The shell member 1 can be formed by forging a metal plate member. FIG. 12 illustrates an example of an exploded view of the shell member 1, and shows a plate-shaped blank 1' before forging. The blank 1' includes slits SL in portions in which the ribs RB1 to RB5 are to be formed. The ribs RB1 to RB5 can be formed by bending the surrounding portions of the slits SL along broken lines BL.

Figure 13A:
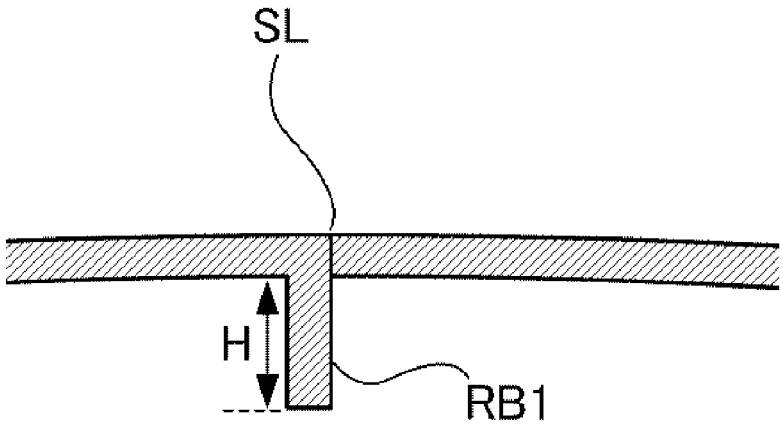
FIG. 13A is a sectional view taken along a line II-II in FIG. 11.

The blank 1' is forged into the outer shape of the shell member 1. The shell member 1 can be formed by connecting the end portions of the silts SL and the portions indicated by the broken lines BL to each other, as shown in FIG. 13A. FIG. 13A is a sectional view taken along a line II-II in FIG. 11, and shows a cross-section of the region surrounding the rib RB1. In this way, the ribs RB1 to RB5 can be formed using portions which overlap each other upon forging of the blank 1' into the outer shape of the shell member 1.

The formation of the shell members 1 to 3 by forging offers a great advantage in easily forming thin shell members 1 to 3. As the head volume increases, it is necessary to reduce the thickness of the peripheral wall of the head. If casting is adopted as a manufacturing method, it is often difficult to reduce the thicknesses of the crown portion 12 and ribs RB1 to RB5 due to factors associated with the molten metal fluidity and the generation of blowholes.

Even if forging is adopted, a method of forming the crown portion 12 and ribs RB1 to RB5 as separate members, and connecting them to each other is troublesome. In this embodiment, a crown portion 12 and ribs RB1 to RB5 with smaller thicknesses can be formed more easily.

In terms of reducing the thickness in this way, the shell members 1 to 3 are preferably all forged members but may be a combination with a forged member. Even if the shell members 1 to 3 are a combination with a forged member, at least the shell member 1 which forms most of the crown portion 12 is preferably a forged member because the formed product is required to attain a given precision.

Although the golf club head 10 is formed by the three shell members 1 to 3 in this embodiment, the number of divided shell members is not limited to this. In this embodiment, the golf club head 100 can also be formed by, for example, a minimum of two shell members.

Also, a height H (see FIG. 13A) of each of the ribs RB1 to RB5 from the crown portion 12 is desirably high to a certain degree to improve the effect of constraining the crown portion 12. The maximum height of each of the ribs RB1 to RB5 is preferably 2.0 mm or more.

Figure 13B:
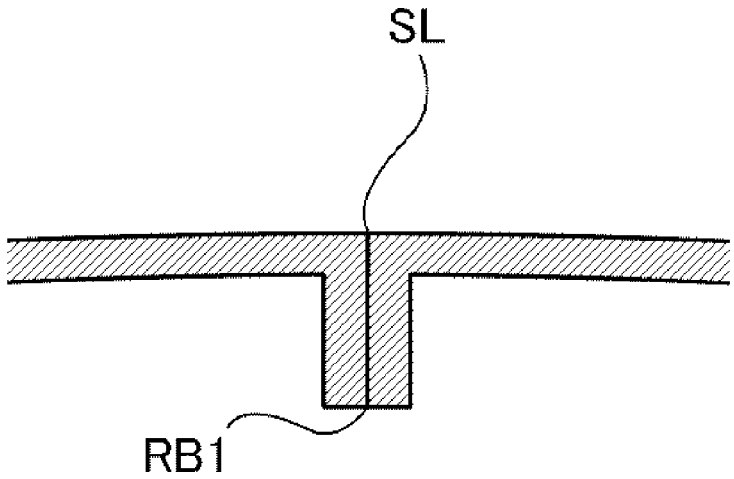
FIG. 13B is a view illustrating another example of how to connect the shell members to each other.

Moreover, the ribs RB1 to RB5 may be formed by bending not the one-side portions of the slits SL but their two-side portions, and connecting them to each other. FIG. 13 illustrates an example of this arrangement, in which the rib RB1 has a two-layered structure upon connection of the two-side portions of the slit SL.

Fifth Embodiment

Figure 14:
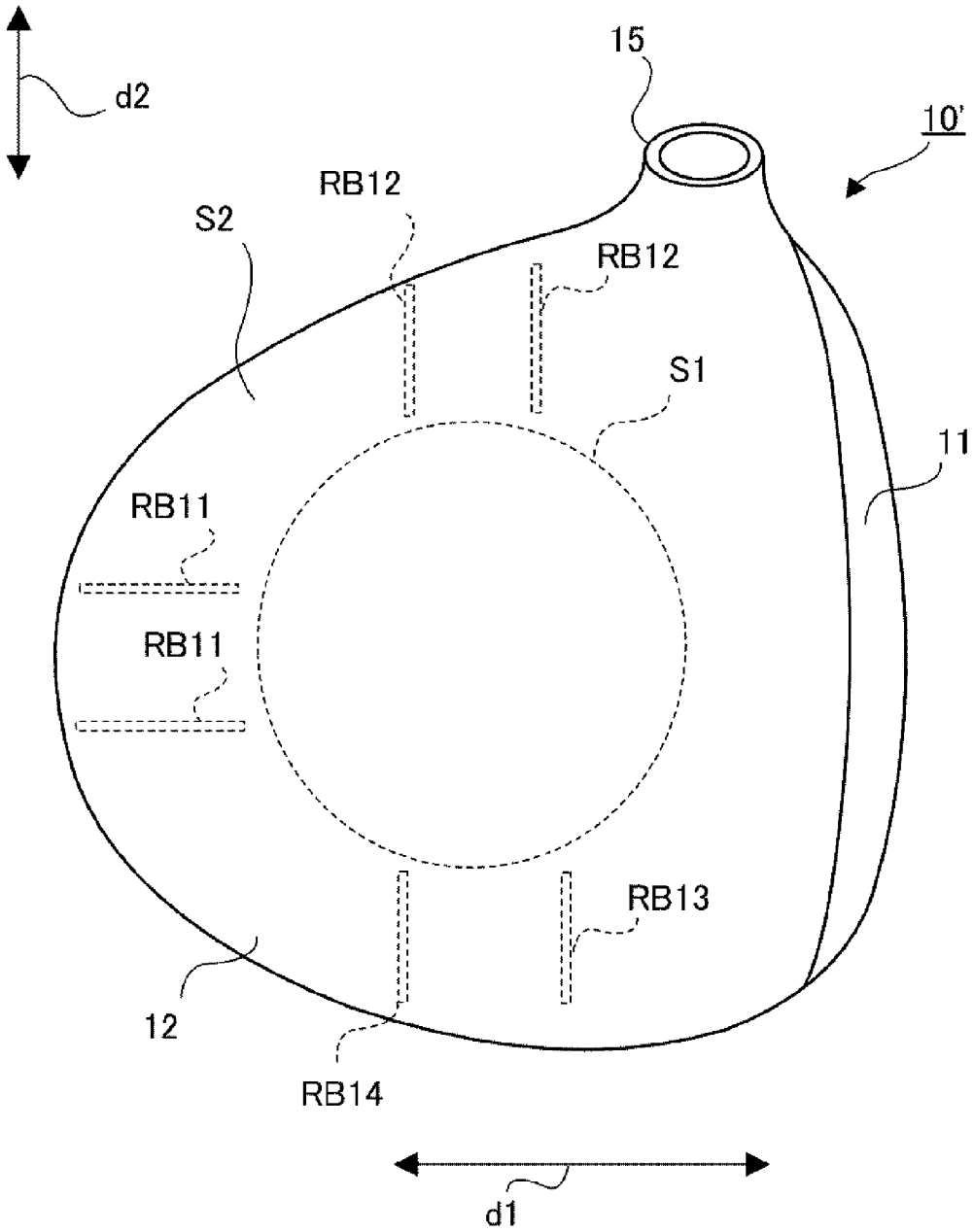
FIG. 14 is a view illustrating another example of the arrangement of ribs.

Although the ribs RB1 to RB5 are arranged in a radial pattern in the above-mentioned fourth embodiment, other arrangements can be adopted. FIG. 14 is a plan view of a golf club head 10' according to this embodiment. The difference between the golf club head 10' and the golf club head 10 according to the above-mentioned fourth embodiment lies in the arrangement of ribs.

The golf club head 10' is provided with a total of six ribs RB11 to RB13. The pair of ribs RB11 are arranged on the back side of a vibration promotion region S1. The pair of ribs RB11 extend parallel to the face-to-back direction indicated by a double-headed arrow d1, and are spaced apart from each other in the toe-to-heel direction indicated by a double-headed arrow d2.

The pair of ribs RB12 are arranged on the heel side of the vibration promotion region S1. The pair of ribs RB12 extend parallel to the toe-to-heel direction indicated by the double-headed arrow d2, and are spaced apart from each other in the face-to-back direction indicated by the double-headed arrow d1.

The pair of ribs RB13 are arranged on the toe side of the vibration promotion region S1. The pair of ribs RB13 extend parallel to the toe-to-heel direction indicated by the double-headed arrow d2, and are spaced apart from each other in the face-to-back direction indicated by the double-headed arrow d1.

All of the ribs RB11 to RB13 extend outwards from the side of the vibration promotion region S1, on the outer side of the vibration promotion region S1. Various other arrangements can also be adopted as the arrangement of ribs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2011-254451, filed Nov. 21, 2011 and 2011-254452, filed Nov. 21, 2011, which are hereby incorporated by reference herein in their entirety.

What is claimed is:

1. A hollow golf club head including a face portion, a crown portion having a shape which bulges out upward, and a sole portion, wherein the crown portion includes a vibration promotion region and a surrounding region which surrounds said vibration promotion region, said vibration promotion region has one of a circular shape and an elliptical shape, and is flatter than said surrounding region, said vibration promotion region is formed at a central portion of the crown portion, said vibration promotion region is thinner than said surrounding region, and said vibration promotion region includes a position of an antinode of the first-order vibration mode of the crown portion.

2. The head according to claim 1, wherein the crown portion is formed by connecting a first member and a second member to each other, and said first member includes said vibration promotion region.

3. The head according to claim 2, wherein a connection portion between said first member and said second member includes a rib.

4. The head according to claim 3, wherein a peripheral edge portion of said first member includes a front edge portion, and a remaining portion other than said front edge portion, said front edge portion is connected to the face portion, said remaining portion is connected to said second member, and said rib is formed across the entire connection portion between said remaining portion and said second member.

5. The head according to claim 3, wherein part of at least one of said first member and said second member forms said rib.

6. The head according to claim 1, wherein said vibration promotion region is flat.

7. The head according to claim 1, wherein a plurality of ribs are formed to extend outwards from a side of said vibration promotion region, on an outer side of said vibration promotion region.

8. The head according to claim 7, wherein said plurality of ribs extend in a radial pattern having said vibration promotion region as a center thereof.

9. The head according to claim 7, wherein the golf club head is formed by connecting a plurality of parts to each other, said plurality of parts include a crown forming part which forms the crown portion, said crown forming part is formed by processing a plate member, said plate member includes slits in portions in which said ribs are to be formed, and said ribs are formed by bending portions of said plate member, which surround said slits.

10. The head according to claim 7, wherein said plurality of ribs are formed in said surrounding region.

11. The head according to claim 7, wherein said vibration promotion region is flat.

12. The head according to claim 7, wherein said vibration promotion region is thinner than said surrounding region.

13. The head according to claim 1, wherein a center of said vibration promotion region is an intersection point between a first virtual line and a second virtual line, the first virtual line is parallel to a virtual line passing in a face-to-back direction through a center of the face portion, and the second virtual line is perpendicular to the first virtual line and passes through a center of the crown portion in the face-to-back direction.

14. The head according to claim 1, wherein an area of said vibration promotion region is 700 to 8,000 $mm^2$.

15. The head according to claim 6, wherein said vibration promotion region has a surface flush with a virtual plane which passes through a boundary between said vibration promotion region and said surrounding region.

* * * * *